US009746251B2

(12) United States Patent
Blomgren

(10) Patent No.: US 9,746,251 B2
(45) Date of Patent: Aug. 29, 2017

(54) PLATE HEAT EXCHANGER PLATE AND A PLATE HEAT EXCHANGER

(71) Applicant: ALFA LAVAL CORPORATE AB, Lund (SE)

(72) Inventor: Ralf Blomgren, Skanor (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 14/428,205

(22) PCT Filed: Oct. 14, 2013

(86) PCT No.: PCT/SE2013/051199

§ 371 (c)(1),
(2) Date: Mar. 13, 2015

(87) PCT Pub. No.: WO2014/065742

PCT Pub. Date: May 1, 2014

(65) Prior Publication Data

US 2015/0233650 A1 Aug. 20, 2015

(30) Foreign Application Priority Data

Oct. 22, 2012 (SE) ..... 1251193

(51) Int. Cl.
*F28F 3/10* (2006.01)
*F28F 3/06* (2006.01)
(Continued)

(52) U.S. Cl.
CPC ..... *F28F 3/06* (2013.01); *F28D 9/00* (2013.01); *F28D 9/005* (2013.01); *F28D 9/0056* (2013.01); *F28F 3/086* (2013.01)

(58) Field of Classification Search
CPC .. F28F 3/086; F28F 3/10; F28D 9/005; F28D 9/0056; F28D 9/0093
(Continued)

(56) References Cited

U.S. PATENT DOCUMENTS 2,197,118 A * 4/1940 Astle ..... A23C 3/0332 165/167
2,221,937 A * 11/1940 Astle ..... F28F 3/083 165/167
(Continued)

FOREIGN PATENT DOCUMENTS

CN 2380891 Y 5/2000
CN 101213414 A 7/2008
(Continued)

OTHER PUBLICATIONS

International Search Report (PCT/ISA/210) mailed on Jan. 16, 2014, by the Swedish Patent Office as the International Searching Authority for International Application No. PCT/SE2013/051199.
(Continued)

*Primary Examiner* — Leonard R Leo
(74) *Attorney, Agent, or Firm* — Buchanan Ingersoll & Rooney PC

(57) ABSTRACT

A plate heat exchanger plate ports and, between the ports, a heat transfer area partly divided by a barrier. The heat exchanger plate comprises a first port, a second port, a third port and a fourth port. Further, the heat exchanger plate is provided with a first transition area between the first and second ports and the heat transfer area, and a second transition area between the third and fourth ports and the heat transfer area, the first and second transition areas being provided with transition ports. The first transition area is open towards the heat transfer area, and the second transition area is separated from the heat transfer area by a sealing.

12 Claims, 7 Drawing Sheets

Figure 1:
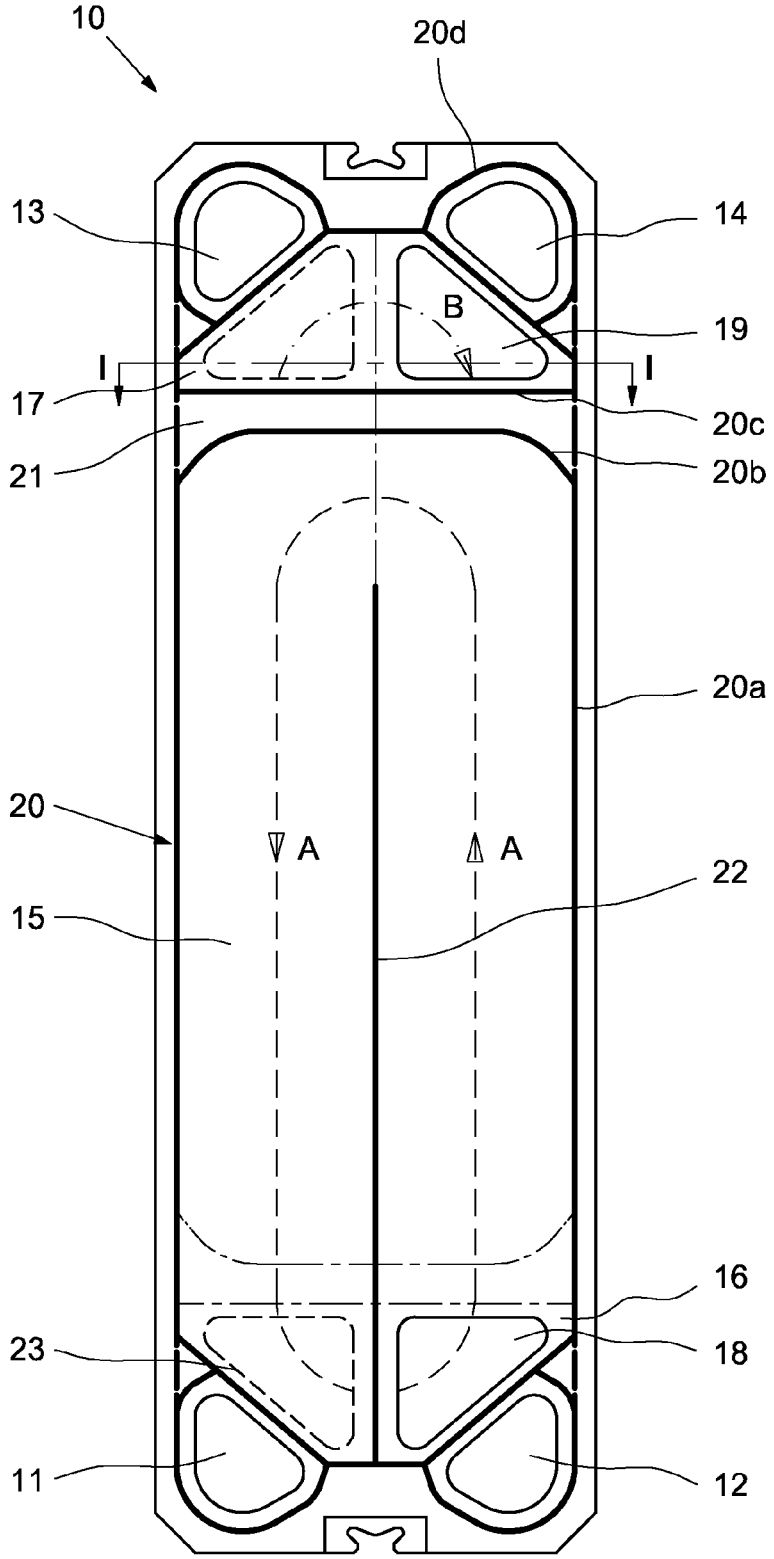

(51) Int. Cl.
*F28D 9/00* (2006.01)
*F28F 3/08* (2006.01)

(58) Field of Classification Search
USPC ..... 165/167
See application file for complete search history.

(56) References Cited

U.S. PATENT DOCUMENTS

| | | | | |
|---|---|---|---|---|
| 2,428,880 | A | 10/1947 | Kintner | |
| 2,582,871 | A | 1/1952 | Kintner | |
| 2,939,686 | A * | 6/1960 | Wildermuth | F28F 3/083 165/167 |
| 3,532,161 | A * | 10/1970 | Lockel | F28D 9/0093 165/167 |
| 4,373,579 | A * | 2/1983 | Jernqvist | F28F 3/083 165/167 |
| 5,042,577 | A | 8/1991 | Suzumura | |
| 5,180,004 | A * | 1/1993 | Nguyen | F28D 9/0093 165/153 |
| 5,547,776 | A | 8/1996 | Fletcher et al. | |
| 5,649,592 | A | 7/1997 | Nishishita | |
| 5,968,321 | A | 10/1999 | Sears | |
| 7,377,308 | B2 * | 5/2008 | Ware | F28D 9/005 165/167 |
| 8,967,238 | B2 * | 3/2015 | Meschke | F28D 9/005 165/166 |
| 2003/0070797 | A1 | 4/2003 | Narahara et al. | |
| 2004/0089438 | A1 * | 5/2004 | Valensa | F28D 9/005 165/4 |
| 2008/0210414 | A1 | 9/2008 | Blomgren et al. | |

FOREIGN PATENT DOCUMENTS

| | | | |
|---|---|---|---|
| DE | 19 10 442 | A1 | 9/1970 |
| EP | 0 108 377 | A1 | 5/1984 |
| FR | 995 395 | A | 11/1951 |
| GB | 615 905 | A | 1/1949 |
| GB | 660 469 | A | 11/1951 |
| GB | 1 252 142 | | 11/1971 |
| GB | 2 019 550 | A | 10/1979 |
| GB | 2054820 | A | 2/1981 |
| JP | S 5634095 | A | 4/1981 |
| JP | 60-80083 | A | 5/1985 |
| JP | 2012-512382 | A | 5/2012 |
| JP | 2014-500469 | A | 1/2014 |
| RU | 2 008 602 | C1 | 2/1994 |
| RU | 2 432 541 | C2 | 4/2007 |
| WO | WO 96/00453 | | 1/1996 |
| WO | 2007142590 | A1 | 12/2007 |
| WO | WO 2009/117886 | A1 | 10/2009 |
| WO | 2012/072386 | A1 | 6/2012 |
| WO | WO2012072386 | a1 * | 6/2012 |

OTHER PUBLICATIONS

Written Opinion (PCT/ISA/237) mailed on Januiary 16, 2014, by the Swedish Patent Office as the International Searching Authority for International Application No. PCT/SE2013/051199.

Chinese Office Action issued May 19, 2016, by the Chinese Patent Office, in corresponding Chinese Patent Application No. 201380055152.5 and an English language translation of the Chinese Office Action (4 pages).

Russian Decision to Grant, issued Aug. 31, 2016, by the Russian Patent Office, in corresponding Russian Patent Application No. 2015119258 (4 pages).

English Translation of the Office Action (Notice of Reasons for Rejection) issued on Jul. 4, 2016 by the Japanese Patent Office in corresponding Japanese Patent Application No. 2015-537662. (6 pages).

Decision to Grant a Patent issued Mar. 6, 2017, by the Japanese Patent Office, in corresponding Japanese Patent Application No. 2015-537662, and English language translation of Decision to Grant a Patent (6 pages).

* cited by examiner

PLATE HEAT EXCHANGER PLATE AND A PLATE HEAT EXCHANGER

FIELD OF THE INVENTION

The present invention relates to a plate heat exchanger plate and a plate heat exchanger comprising a plurality of said plates. More specifically, the present invention relates to a heat exchanger plate for a plate heat exchanger, comprising ports and a heat transfer area arranged between said ports for allowing heat transfer between a first medium and a second medium. Plate heat exchangers are generally used for providing heat transfer between media, such as fluids or liquids, for various purposes, such as heating or cooling.

PRIOR ART

There are numerous different types of plate heat exchangers and heat exchanger plates in the prior art. One such type of prior art plate heat exchanger is a counter current flow plate heat exchanger comprising a plurality of heat exchanger plates arranged beside each other to form, in alternating order, first and second interspaces between adjacent plates for a first media and a second media. The heat exchanger plates comprise a heat transfer area forming a heat transfer channel in each of the interspaces, and a transition area forming a transition section in each of the interspaces for conducting a medium through an interspace without entering the heat transfer channel of said interspace. The heat exchanger plates also comprise ports forming inlet and outlet conduits arranged for conducting the first medium into and out from the heat transfer channel of the first interspaces and the transition section of the second interspaces, and for conducting the second medium into and out from the heat transfer channel of the second interspaces and the transition section of the first interspaces. Some heat exchanger plates of prior art comprise a pattern of corrugations and/or barriers or similar to provide suitable flow and heat transfer properties.

Even though the field of plate heat exchangers has been subject to extensive research, improvements are needed to provide more efficient heat exchangers suitable for different purposes.

A problem with plate heat exchangers according to the prior art is that a flow path through the plate heat exchanger must be short due to pressure drop limitations, which means that the number of heat exchanger plates is small. A small number of heat exchanger plates results in expensive heat exchangers because of frame cost.

A drawback with prior art plate heat exchangers is that the flow rate through the plate heat exchanger will be low in an industrial application. This results in bigger heat exchanger plates, which increases the cost.

SUMMARY OF THE INVENTION

An object of the present invention is to avoid drawbacks and problems of the prior art and provide more efficient heat exchanging properties for special purposes. The heat exchanger plate and the plate heat exchanger according to the invention results in a possibility to provide substantially helical flow paths in plate heat exchangers with a relatively large number of plates, which results in a favourable flow rate and cost efficient heat exchangers for special purposes.

The present invention relates to a plate heat exchanger plate comprising ports and, between said ports, a heat transfer area partly divided by a barrier, characterised in that the heat exchanger plate comprises a first port, a second port, a third port and a fourth port, wherein the heat exchanger plate is provided with a first transition area between the first and second ports and the heat transfer area, a second transition area between the third and fourth ports and the heat transfer area, the first and second transition areas being provided with transition ports, wherein the first transition area is open towards the heat transfer area, and wherein the second transition area is separated from the heat transfer area by a sealing. The configuration of the first, second, third and fourth ports in combination with the transition areas and the barrier result in a plate allowing for a helical flow path through a plate heat exchanger including a plurality of said plates, wherein all inlet and outlet ports for both a first medium and a second medium can be arranged in a common frame plate, such as a frame plate fixed to a foundation in the form of a floor or similar. Hence, a heat exchanger having, in some aspects, the properties of a spiral heat exchanger and, in other aspects, the properties of a plate heat exchanger is provided, wherein the cost efficiency of the plate heat exchanger is combined with flow properties of a spiral heat exchanger.

The plate can be substantially rectangular having opposite short sides and opposite long sides. The first and second ports can be arranged at one of said short sides, wherein the third and fourth ports can be arranged at the opposite short side.

The barrier can comprise a free end located in the heat transfer area to form a gap between the free end and the second transition area. Further, the barrier can extend through the first transition area and can extend along a longitudinal centre line of said plate. Hence, a U-shaped flow through the heat transfer area can be provided.

The first transition area can be arranged adjacent to the first and second ports, and the second transition area can be arranged adjacent to the third and fourth ports, wherein at least one of said ports is sealed off from the adjacent transition area. The first and second ports and the third and fourth ports can be sealed off from the adjacent transition area. Hence, said ports can form inlet and outlet conduits through a plurality of plates to divide a plate package in plate package sections. In the beginning and the end of each plate package section one or more of said ports communicate with the corresponding transition area to conduct media into and out from the plate package sections. For example, a part of the seal, such as a part of a gasket, between said one or more ports and the adjacent transition area can be removed.

The sealing can be formed by gaskets. The gaskets can be arranged in gasket grooves in the plate. A plate heat exchanger formed by the plates can be a gasketed plate heat exchanger with helical counter current flow.

The present invention also relates to a plate heat exchanger comprising a plate package with plate heat exchanger plates as described herein. The plate package can be divided in sections with a plurality of plates in each section. For example, the number of plates is the same in each section. In each section proportional amounts of the first and second media can undergo a full thermal program, wherein the inlet and outlet temperatures are the same in all sections. The number of sections in the plate package and the number of plates in the sections can be adapted to the thermal duty. The number of sections gives the capacity of the heat exchanger, and the number of plates in the sections gives the thermal program, which means that the total heat transfer area can be minimized and consequently the cost as well.

Further characteristics and advantages of the present invention will become apparent from the description of the embodiments below, the appended drawings and the dependent claims.

SHORT DESCRIPTION OF THE DRAWINGS

Figure 2:
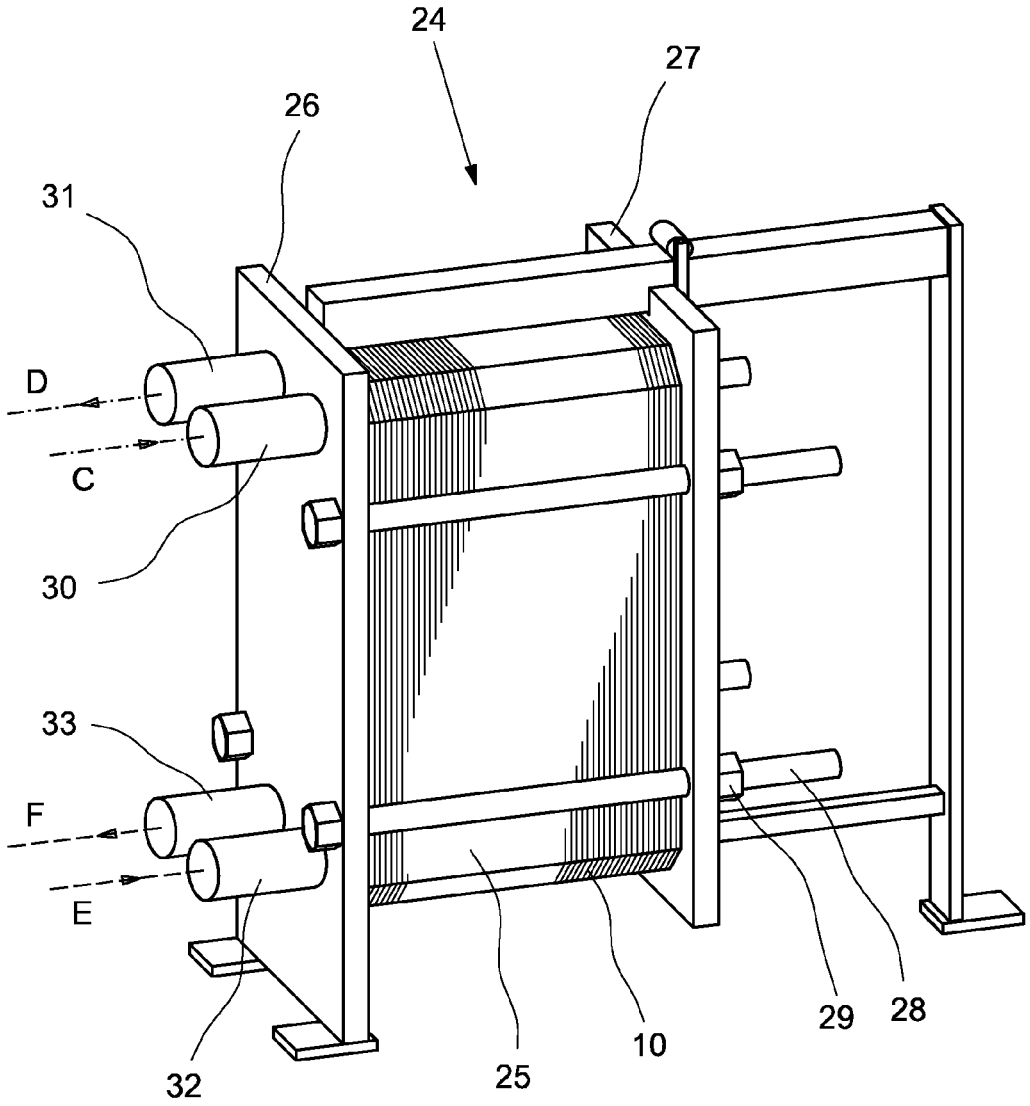
Figure 3:
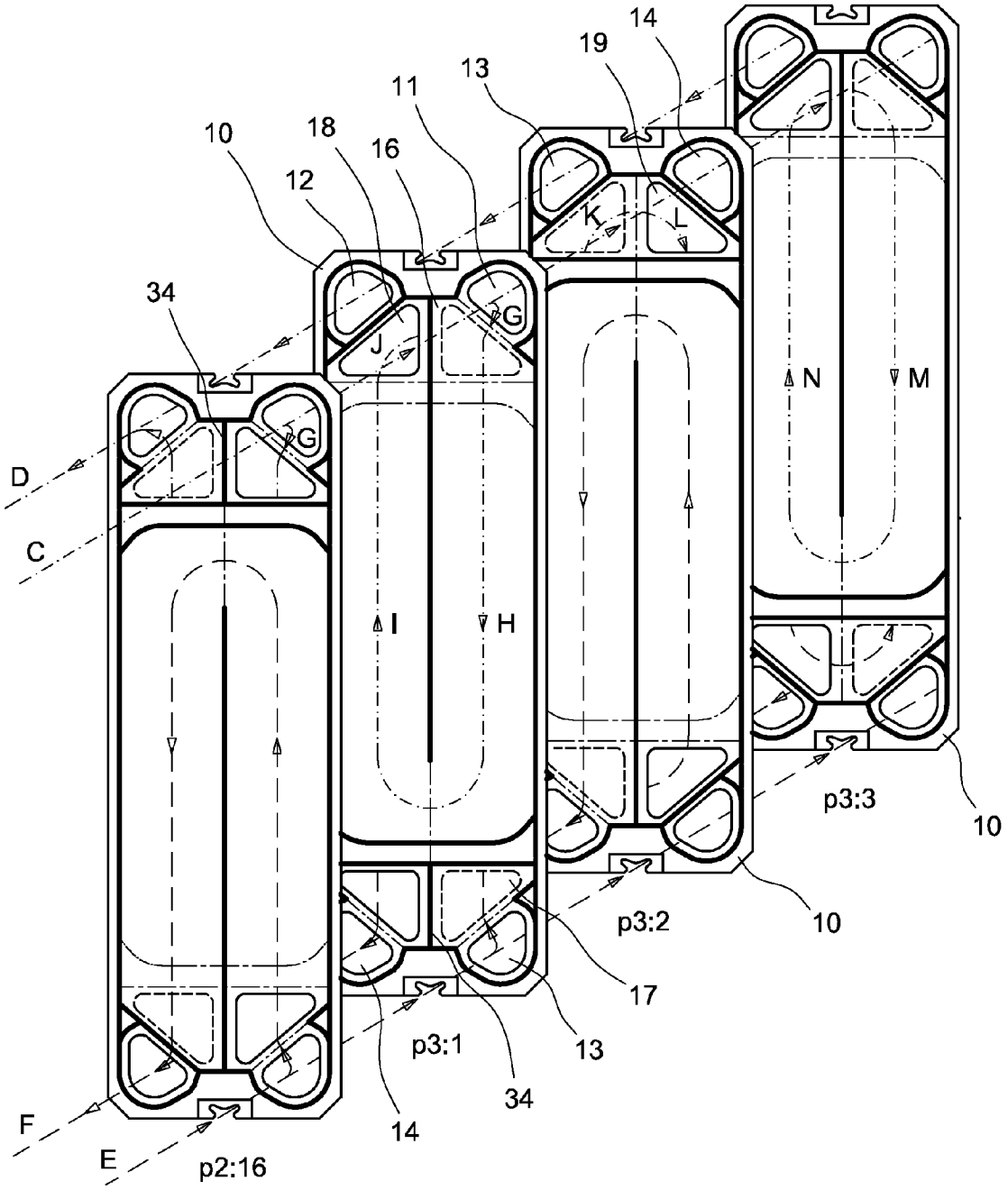
Figure 4:
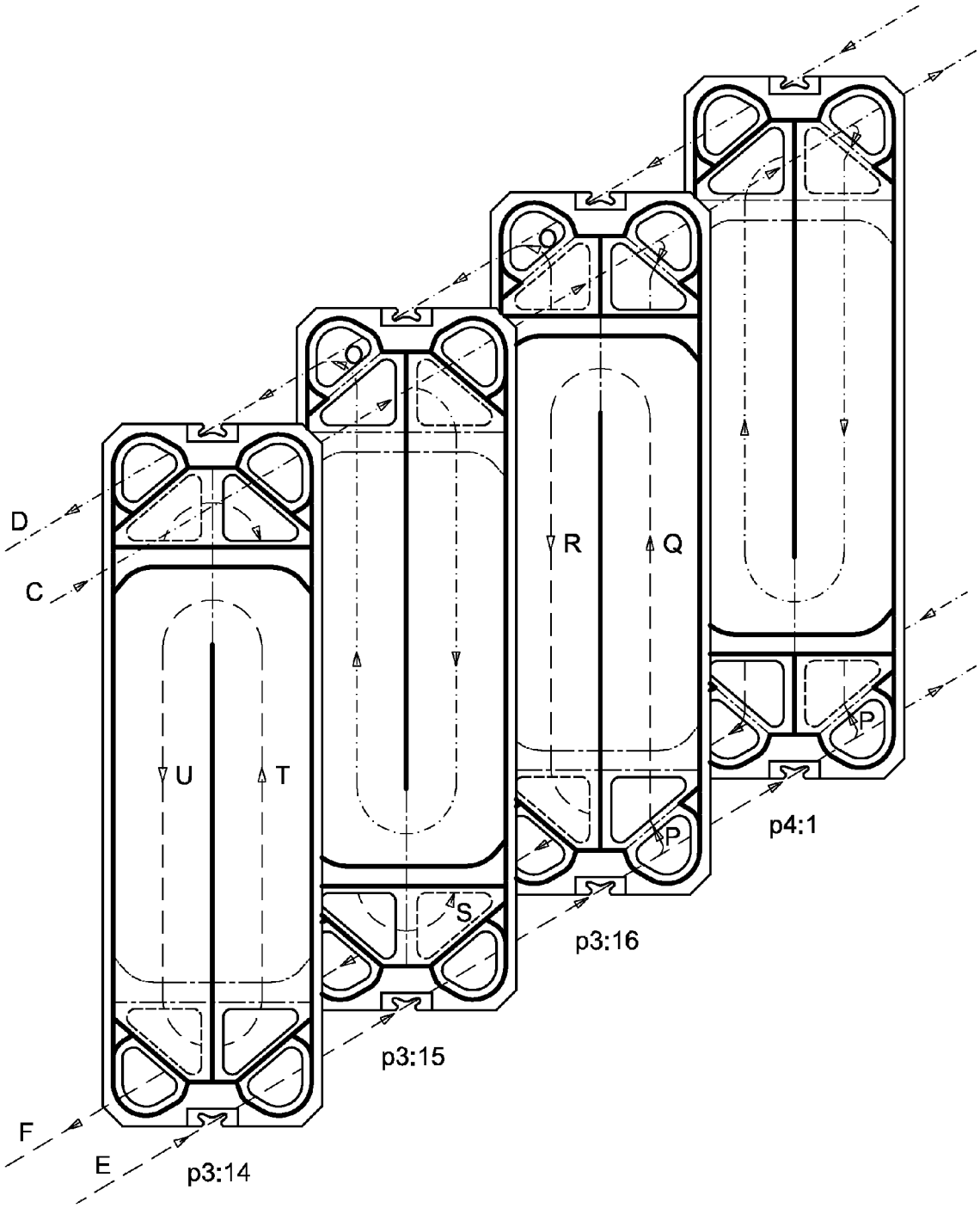
Figure 5:
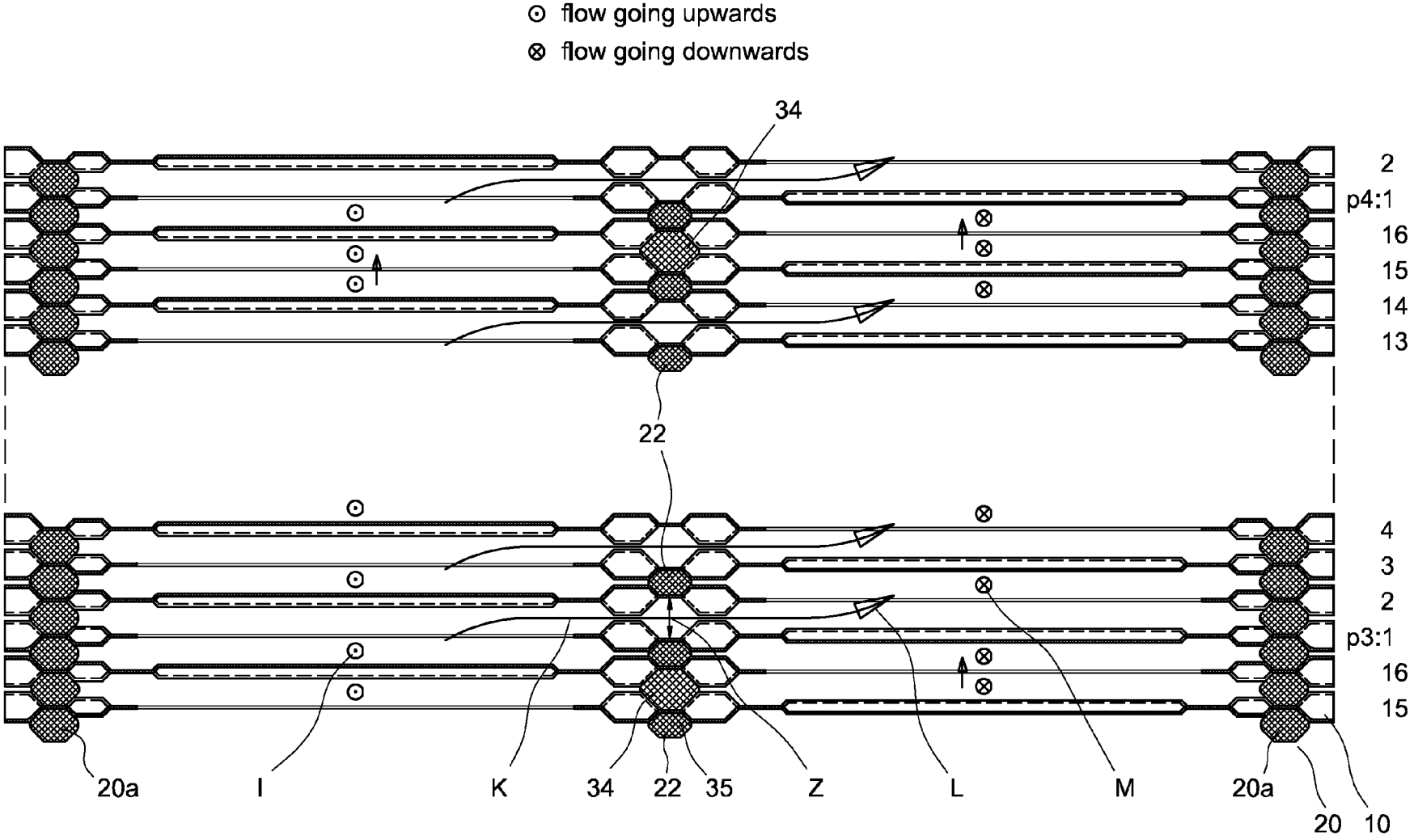
Figure 6:
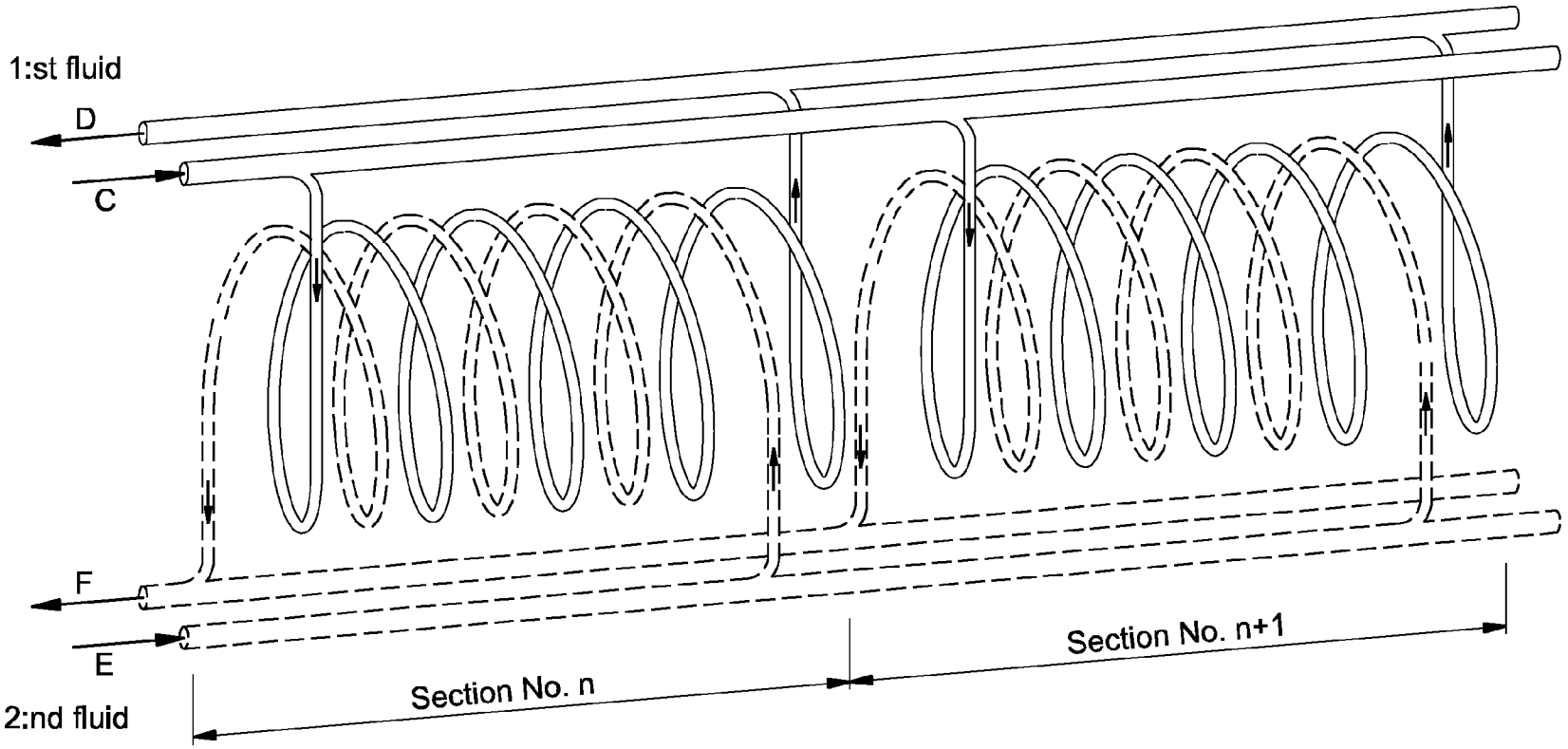
Figure 7:
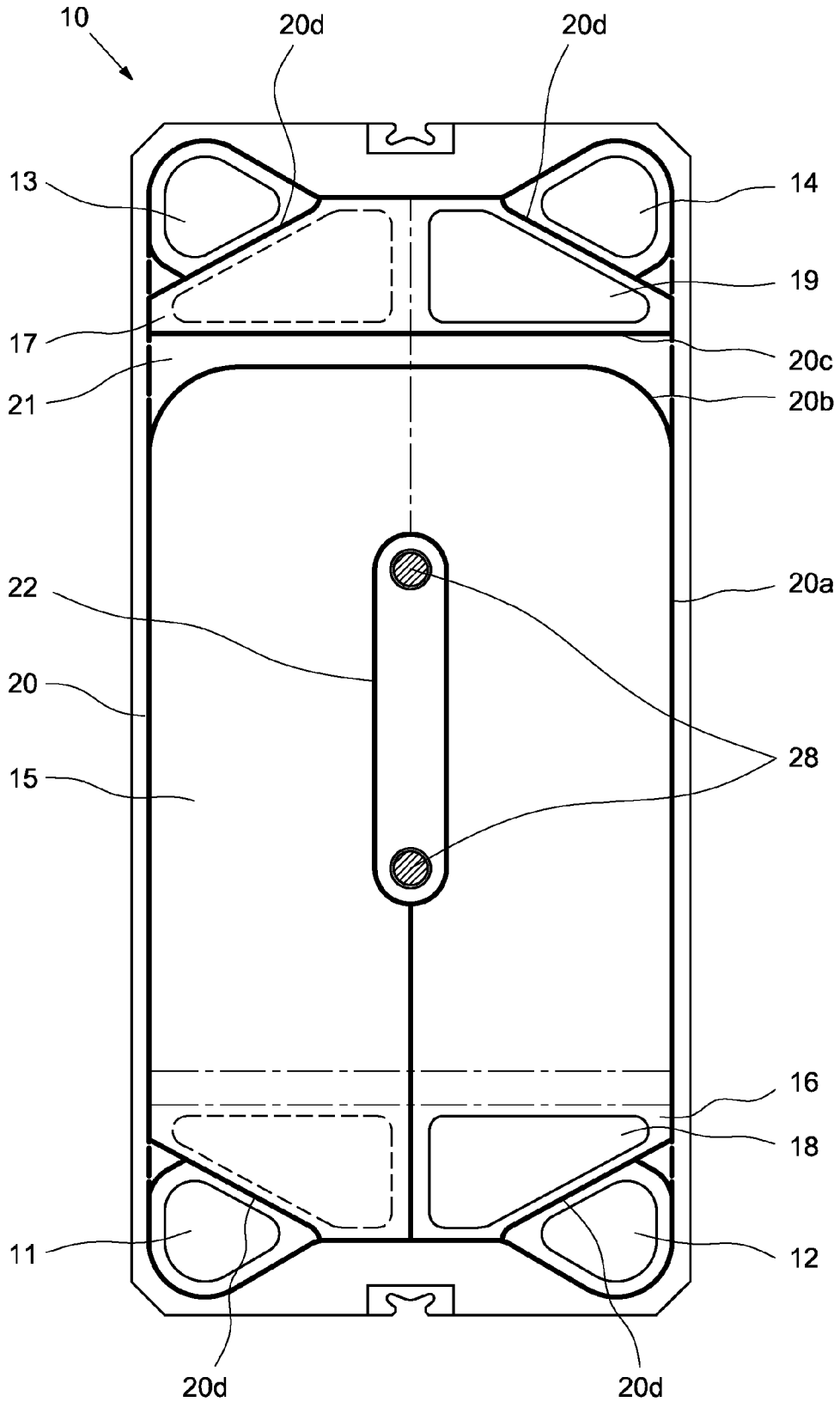

The invention will now be described more in detail with the aid of embodiments and with reference to the appended drawings, in which FIG. 1 is a schematic front view of a heat exchanger plate for a plate heat exchanger according to one embodiment of the present invention, FIG. 2 is a schematic perspective view of an example of a plate heat exchanger comprising a plurality of plates according to FIG. 1, FIG. 3 is a schematic exploded view of a portion of the plate heat exchanger according to FIG. 2, illustrating the flow path in the beginning of a plate package section of the plate heat exchanger, FIG. 4 is a schematic view according to FIG. 3, illustrating the flow path in the end of the plate package section, FIG. 5 is a schematic cross section view along line I-I in FIG. 1, showing a portion of the plate heat exchanger according to FIG. 2, illustrating the flow path through a plate package section, FIG. 6 is a schematic perspective view, illustrating the flow path through two adjacent plate package sections, FIG. 7 is a schematic view of heat exchanger plate for a plate heat exchanger according to one alternative embodiment of the present invention,

DETAILED DESCRIPTION OF EMBODIMENTS

Referring to FIG. 1 a heat exchanger plate 10 for a plate heat exchanger is illustrated schematically. According to the illustrated embodiment the plate 10 is substantially rectangular having two opposite short sides and two opposite long sides. However, other configurations, such as quadratic, oval, circular, etc., may be possible. The plate 10 is, for example, formed in sheet metal with indentations and embossments accomplished by pressing.

The plate 10 comprises a first port 11, a second port 12, a third port 13 and a fourth port 14. The ports 11-14 are through apertures for allowing a medium to pass through the plate 10. For example, the first port 11 and the second port 12 are arranged at one short side of the plate 10, wherein the third port 13 and the fourth port 14 are arranged at the opposite short side of the plate 10. For example, the ports 11-14 are arranged at the corners of the plate 10.

The plate 10 comprises a heat transfer area 15 arranged between said ports 11-14. For example, the heat transfer area 15 form a substantial area of the plate 10 to allow heat transfer between media flowing on opposite sides of the plate 10. The plate 10 is, for example, provided with suitable corrugations or similar in the heat transfer area 15 to obtain suitable flow and heat transfer characteristics in a conventional manner.

The plate 10 comprises a first transition area 16 and a second transition area 17. The first transition area 16 is provided with a first transition port 18 for allowing a medium to pass through the plate 10. The second transition area 17 is provided with a second transition port 19 for allowing a medium to pass through the plate 10. The first transition area 16 is arranged between the first ports 11, 12 and the heat transfer area 15, wherein the second transition area 17 is arranged between the second ports 13, 14 and the heat transfer area 15.

The plate 10 comprises a first side and a second side, such as a front side and a rear side. It is, however, to be understood that a plurality of plates 10 cooperate in a plate heat exchanger, such that the front side of one plate cooperate with the rear side of an adjacent plate. For simplicity, the areas 15-17 are indicated on the front side and the functions thereof are described with reference to the front side, wherein the effects on the rear side, by cooperation with the front side of an adjacent plate, are understood by a skilled person and are described herein with reference to the front side of said adjacent plate.

The first transition area 16 is open towards the heat transfer area 15 for allowing a medium to flow between the first transition area 16 and the heat transfer area 15. For example, the first transition port 18 is arranged for allowing a medium to flow into the first transition area 16 and further into the heat transfer area 15, which is illustrated by means of the arrow A in FIG. 1. Alternatively, the first transition port 18 is arranged for allowing a medium to flow out from the heat transfer area 15 and the first heat transition area 16.

The second transition area 17 is separated from the heat transfer area 15 by a sealing 20, so that a medium in the second transition area 17 cannot enter the heat transfer area 15 of the front side of the same plate 10. Hence, for a given plate 10, such as every other plate in a plate package of said plates, the first transition area 16 and the heat transfer area 15 are adapted for a first medium, which is illustrated by the dashed line in FIG. 1, wherein the second transition area 17 is adapted for a second medium, which is illustrated by the dashed and dotted line in FIG. 1. For example, the second transition port 19 is arranged for allowing a medium to flow out from the second transition area 17 to the opposite side of the plate 10, which is illustrated by means of the arrow B in FIG. 1. Alternatively, the second transition port 19 is arranged for allowing a medium to flow into the second transition area 17.

In the illustrated embodiment the plate 10 also comprises an optional leak area 21 arranged between the heat transfer area 15 and the second transition area 17. The leak area 21 is, for example, arranged in a conventional manner.

In the embodiment of FIG. 1 the sealing 20 surrounds the ports, 11-14, the second transition area 17, the leak area 21 and the common area formed by the heat transfer area 15 and the first transition area 16. For example, the sealing 20 is a gasket, such as a rubber gasket, forming a perimeter gasket 20*a*, an inner transversal gasket 20*b* between the heat transfer area 15 and the leak area 21, an outer transversal gasket 20*c* between the second transition area 17 and the leak area 21 and port gaskets 20*d* around each of the ports 11-14. Hence, the outer transversal gasket 20*c* extends from the perimeter gasket 20*a* at one long side of the plate 10 to the perimeter gasket 20*a* at the opposite long side to separate the second transition area 17 from the heat transfer area 15. For example, the plate 10 is provided with gasket grooves for receiving the sealing 20 in the form of said gaskets 20*a*-20*d*.

The plate 10 is provided with a barrier 22 partly dividing the heat transfer area 15. For example, the barrier 22 is formed by the sealing 20. For example, the barrier 22 is a divider gasket. The barrier 22 is arranged to provide a substantially helical flow of the medium. In the embodiment of FIG. 1 the barrier 22 extends through the first transition area 16 and through a substantial part of the heat transfer area 15 leaving a gap between a free end of the barrier 22 and the second transition area 17. For example, the barrier 22 extends continuously from the perimeter gasket 20*a* towards the inner transversal gasket 20*b*, leaving a gap between the free end of the barrier 22 and the inner transversal gasket 20*b*. The barrier 22 divides the heat transfer area 15 and the first transition area 16 in two compartments having substantially opposite flow directions. For example, the barrier 22 extends along a longitudinal centre line of said plate, such as in parallel to the long sides of the plate 10. In the illustrated embodiment, the barrier 22 is arranged so that a medium entering through the first transition port 18 is forced towards the second transition area 17, around the free end of the barrier 22 and then back towards the first transition area 16 on the other side of the barrier 22 as illustrated by the arrows A. The plate 10 is optionally provided with indications 23 for further transition ports as indicated by dashed lines in FIG. 1.

With reference to FIG. 2 a plate heat exchanger 24 according to one embodiment is illustrated. The plate heat exchanger 24 comprises a plate package 25, a frame plate 26 and a pressure plate 27. For example, the frame plate 26 is fixed to a foundation, such as a floor, wall or similar, wherein the pressure plate 27 is detachable. The plate package 25 includes a plurality of heat exchanger plates 10 and is arranged between the frame plate 26 and the pressure plate 27. For example, the plate package 25, the frame plate 26 and the pressure plate 27 are held together by one or more tightening bolts 28 with nuts 29 or by means of any other suitable fastening means. The frame plate 26 is provided with a first inlet connection 30, a first outlet connection 31, a second inlet connection 32 and a second outlet connection 33. Hence, all four inlet and outlet connections 30-33 are arranged in the frame plate 26, wherein the pressure plate 27 is not provided with any inlet or outlet connections. The first inlet connection 30 is arranged for introducing a first medium into the plate heat exchanger 24, which is indicated by the arrow C in FIG. 2. The first outlet connection 31 is arranged for conducting the first medium out of the plate heat exchanger 24, which is indicated by the arrow D in FIG. 2. The second inlet connection 32 is arranged for introducing a second medium into the plate heat exchanger 24, which is indicated by the arrow E in FIG. 2. The second outlet connection 33 is arranged for conducting the second medium out of the plate heat exchanger 24, which is indicated by the arrow F in FIG. 2. For example, the first inlet connection 30 and the first outlet connection 31 are arranged for communicating with the ports 11-14 at one short side of the plate 10, wherein the second inlet connection 32 and the second outlet connection 33 are arranged for communicating with the ports 11-14 at the opposite short side of the plate 10.

With reference to FIGS. 3-5 a number of plates 10 of the plate package 25 are illustrated to show the flow path of the first medium and the second medium into, through and out of the plate heat exchanger 24 according to one embodiment example. FIGS. 3 and 4 are exploded views and in FIG. 5 the plates are illustrated with a gap between them for clarity. In the illustrated embodiment the plate package 25 is divided in plate package sections. In FIG. 3 the end of a second plate package section and the beginning of a third plate package section is illustrated. The last plate 10 of the second plate package section is indicated with p2:16 in FIG. 3, the first plate 10 of the third plate package section is indicated with p3:1, the second plate 10 of the third plate package section is indicated with p3:2 and the third plate 10 of the third plate package section is indicated with p3:3. In FIG. 4 the end of the third plate package section and the beginning of a fourth plate package section is illustrated, wherein the plates 10 are indicated correspondingly.

The plates 10 in the plate package 25 form, in alternating order, first and second interspaces between adjacent plates 10. In said interspaces, the heat transfer areas 15 of the plates 10 form heat transfer channels, the first transition areas 16 form first transition sections and the second transition areas 17 form second transition sections. It is understood that the front side of one plate cooperate with the rear side of an adjacent plate. For simplicity, the areas 15-17 are indicated on the front side and the heat channels and transition sections they form are described with reference to the front side. The first transition sections communicate with the heat transfer channel of the same interspace and with the second transition section of an adjacent interspace. For example, every other plate 10 is rotated 180 degrees in its plane, i.e. around an axis extending through the plate heat exchanger 24 in a direction perpendicular to the plane of the plates 10. Alternatively, every other plate 10 is rotated 180 degrees around its longitudinal centre line and/or formed to provide a similar alternating effect. In the illustrated embodiment, the plate heat exchanger 24 is a counter current flow heat exchanger.

The ports 11-14 form inlet and outlet conduits in the plate package 25, which inlet and outlet conduits are connected to the inlet and outlet connections 30-33 of the frame plate 26. For example, the ports 11-14 form a first inlet conduit connected to the first inlet connection 30, a first outlet conduit connected to the first outlet connection 31, a second inlet conduit connected to the second inlet connection 32 and a second outlet conduit connected to the second outlet connection 33. For example, the first inlet conduit is formed by the first port 11 of every second plate 10 and the fourth port 14 of the remaining plates 10. The first inlet and outlet conduits are arranged through the plate package 25 at one short side of the plates 10 and the second inlet and outlet conduits are arranged through the plate package 25 at the opposite short side of the plates 10. Hence, the inlet and outlet conduits extend axially through the plate package 25 in a direction perpendicular to the planes of the plates 10.

The plate package 25 comprises a plurality of plate package sections. In FIGS. 3-5, plates of different plate package sections are indicated with the letter "p" followed by the section number, which is followed by the plate number within the relevant section. In FIGS. 3-5, a third section of a plate package 24 is illustrated as an example. The plate package 25 comprises at least two different types of plates 10, i.e. intermediary plates, which for the third section in the plate package 24 are indicated p3:3-p3:14, and end plates, which for the third section of the plate package 24 are indicated p3:1, p3:16. The intermediary plates p3:3-p3:14 are arranged between the end plates p3:1, p3:16. In the illustrated embodiment, the plate package 25 comprises three different types of plates 10, i.e. the intermediary plates p3:3-p3:14, the end plates p3:1, p3:16 and secondary end plates, which for the third section in the plate package 24 are indicated p3:2, p3:15, wherein the secondary end plates p3:2, p3:15 are arranged between the end plates p3:1, p3:16 and the intermediary plates p3:3-p3:14. A plate package section comprises a plurality of intermediary plates p3:3-p3:14, one end plate p3:1, p3:16 at each end of the plate package 25 and, optionally, one secondary end plate p3:2, p3:15 adjacent to each end plate p3:1, p3:16.

The sealing 20, such as the port gaskets 20*d*, of the intermediary plates p3:3-p3:14 seals off the ports 11-14 from the transition sections formed by the transition areas 16, 17.

Hence, the inlet and outlet conduits formed by the ports 11-14 extend through intermediary interspaces formed by said intermediary plates p3:3-p3:14 without conducting any media to the transition sections or the heat channels.

In the end plates p3:1, p3:16 at least one of the first and third ports 11, 13 and/or at least one of the second and fourth ports 12, 14 communicate with the first or second transition sections. In the secondary end plates p3:2, p3:15 at least one of the first and third ports 11, 13 and/or at least one of the second and fourth ports 12, 14 communicate with the first or second transition sections. Hence, specific ports 11-14 are open towards the transition areas 16, 17 in the end plates p3:1, p3:16, wherein there is no sealing 20 between said ports 11-14 and the transition areas 16, 17. For example, in the first end plate p3:1 there is no sealing between the first port 11 and the first transition area 16, so that the first medium can flow from the first inlet conduit into the first transition section and further to the heat transfer channel formed by the heat transfer area 15 of said first end plate p3:1. Further, in said first end plate p3:1 there is no sealing between the fourth port 14 and the second transition area 17, so that the second medium can flow out from the second transition section formed by the second transition area 17 of said first end plate p3:1 and into the second outlet conduit. Optionally, there is no sealing between the third port 13 and the second transition area 17. The last end plate p3:16 of a plate package section is, for example rotated 180 degrees in its plane in relation to the first end plate p3:1 of said plate package section, wherein the first medium is conducted out from the second transition section formed by the second transition area 17 of the second end plate p3:16 and into the first outlet conduit and wherein the second medium is conducted into the first transition section formed by the first transition area 16 of the second end plate p3:16. Optionally, the secondary end plates p3:2, p3:15 also communicate with the inlet and/or outlet conduits. For example, in the secondary end plates p3:2, p3:15 one port 11-14 is open towards the first or second transition area 16, 17, as illustrated by the second and fifteenth plates p3:2 and 3:15 of the third plate package section of FIGS. 3 and 4.

The plate heat exchanger 24 is arranged so that the first medium is introduced into the third plate package section formed by the plates p3:1-p3:16 through the first inlet conduit formed by the first and fourth ports 11, 14 in a direction illustrated by means of the arrow C in FIG. 3. As the first port 11 communicates with the first transition section formed by the first transition area 16 of the first end plate p3:1, the first medium is conducted from the first inlet conduit to the first transition section, which is illustrated by means of the arrow G, and further into the heat transfer channel formed by the heat transfer area 15 of said plate p3:1, which is illustrated by means of the arrow H. Then, the first medium is conducted along the barrier 22 to the gap between the free end of the barrier and the inner transversal gasket 20*b*, wherein the first medium is forced to turn 180 degrees around the free end of the barrier 22 and is conducted back towards the first transition section, which is illustrated by means of the arrow I. The first medium will exit the interspace formed by the first end plate p3:1 and the last end plate of the previous plate package section p2:16 through the first transition port 18, which is illustrated by means of the arrow J, and enter the second transition section formed by the second transition area 17 of the next plate p3:2, which is illustrated by means of the arrow K, wherein the first medium will pass through the interspace formed by the first end plate p3:1 and the plate p3:2, turn 180 degrees and exit the second transition section through the second transition port 19 as illustrated by means of the arrow L, and continue into the first transition section of the interspace formed by plates p3:2 and p3:3. Then, the first medium will start another loop around the barrier 22 as illustrated by means of the arrows M and N, forming a substantially helical flow path through the plate package section formed by the plates p3:1-p3:16. In the last end plate p3:16 and/or the secondary end plate p3:15 the first or second transition section communicates with the corresponding second or third port 12, 13 so that the first medium will exit said transition section and enter the first outlet conduit, which is illustrated by means of the arrows O in FIG. 4. Then the first medium can exit the plate package 25 through the first outlet conduit as illustrated by the arrows D in FIG. 4 and FIG. 3.

The second medium is conducted through the second inlet conduit formed by the second and third ports 12, 13 to the last end plate p3:16 as illustrated by means of the arrows E in FIGS. 3 and 4. Then, the second medium is introduced into the first transition section as illustrated by means of the arrow P in FIG. 4. For example, the second medium is also introduced into said first transition section through the following interspace, i.e. through plate p4:1 in the illustrated embodiment. The flow path of the second medium is substantially helical in the opposite direction as the first medium as illustrated by the arrows Q-U. The second medium enters the second outlet conduit in the first end plate p3:1 and/or the secondary end plate p3:2 to exit the plate package section, which is illustrated by the arrows F.

As illustrated in FIGS. 3-5 the second transition area 17 of the end plates p3:1 and p3:16 is provided with a divider sealing 34, such as a gasket. The divider sealing 34 divides the second transition area 17, and the second transition section formed thereof, into two separated compartments, wherein one of said compartments is arranged for introducing a medium into the second transition section from one of the third and fourth ports 13, 14, and the other compartments is arranged for conducting the same medium out from the second transition second and into the other of the third and fourth ports 13, 14.

With reference to FIG. 5 the flow of the first medium is illustrated, wherein the flow is indicated with the letters used for the arrows in FIG. 3 to illustrate the corresponding flow positions.

Optionally, as illustrated I FIG. 5, a pattern of the plates 10 is asymmetric along a vertical middle line in the transition area in order to increase the distance Z between gasket groove bottoms 35 in channels conducting the media as illustrated by the arrows in FIG. 5. Hence, the corresponding gaskets have different cross sections. For example, the divider sealing 34 is formed deeper than the barrier 22.

The flow path obtained by the heat exchanger plates according to the disclosed embodiment is illustrated schematically in FIG. 6, wherein the first medium is indicated by means of continuous lines and the second medium is indicated by means of dashed lines. In FIG. 6 two adjacent plate package sections n and n+1 of the plate package 25 are illustrated. The inlet and outlet conduits formed by the ports 11-14 conduct the first and second media into and out from the interspaces between adjacent plates 10 as illustrated by the arrows C-F in FIG. 6 to provide a helical counter current flow through each plate package section n. The plate package 25 includes any suitable number of plate package sections n arranged in a corresponding manner.

FIG. 7 shows one alternative embodiment of the plate 10, wherein additional tightening bolts 28 are arranged along a centre line of the plate 10. For example, the tightening bolts 28 are enclosed by a part of the sealing 20 forming the barrier 22 with the gap between the free end of the barrier 22 and the second transition area 17, such as between the free end of the barrier 22 and the inner transversal gasket 20*b*. With tightening bolts 28 arranged along the centre line of the plate 10 it is possible to have wider plates, for example, in combination with relatively thin frame plate and pressure plate.

In order to avoid thermal influence between the sections the plate package can have at least one empty channel between the sections. The empty channel with air has an insulating effect and the heat transfer between the outermost channels in adjacent sections is eliminated.

For example, in the described plate heat exchanger one plate type with minor modifications of the gasket is used, and to form the plate package every second plate is rotated 180 degrees. It is of course possible to use two matching plate types as well.

The invention claimed is:

1. A plate heat exchanger comprising a plate package comprised of a plurality of plate heat exchanger plates, the plurality of plate heat exchanger plates each comprising:

ports and, between said ports, a heat transfer area partly divided by a barrier, wherein the ports comprise a first port, a second port, a third port and a fourth port, wherein the heat exchanger plate is provided with a first transition area between the first and second ports and the heat transfer area, a second transition area between the third and fourth ports and the heat transfer area, the first and second transition areas being provided with transition ports passing through the plate heat exchanger plate, wherein the first transition area is open towards the heat transfer area, and wherein the second transition area is separated from the heat transfer area by a sealing; and said plates forming interspaces between adjacent plates, wherein, in said interspaces, the heat transfer areas of the plates form heat transfer channels, the first transition areas form first transition sections and the second transition areas form second transition sections, wherein the first transition sections communicate with the second transition sections of adjacent interspaces, and wherein the ports form inlet and outlet conduits in the plate package, which inlet and outlet conduits extend through a plurality of adjacent intermediate interspaces of a plate package section of the plate package sealed off from the transition sections, and communicate with transition sections of interspaces of said plate package section arranged before and after said intermediate interspaces.

2. A plate heat exchanger according to claim 1, wherein the first and second ports are for a first medium, and the third and fourth ports are for a second medium.

3. A plate heat exchanger according to claim 1, wherein the barrier comprises a free end located in the heat transfer area to form a gap between the free end and the second transition area.

4. A plate heat exchanger according to claim 1, wherein the barrier extends through the first transition area.

5. A plate heat exchanger according to claim 1, wherein the barrier extends along a longitudinal centre line of said plate.

6. A plate heat exchanger according to claim 1, wherein the first transition area is arranged adjacent to the first and second ports, and the second transition area is arranged adjacent to the third and fourth ports, and wherein at least one of the said ports is sealed off from the adjacent transition area.

7. A plate heat exchanger according to claim 1, wherein the first, second, third and fourth ports are sealed off from the adjacent transition area.

8. A plate heat exchanger according to claim 1, wherein said plate is provided with gasket grooves and gaskets forming the sealing.

9. A plate heat exchanger according to claim 1, wherein said plate is made of a thin metallic sheet with a pattern accomplished by pressing.

10. A plate heat exchanger according to claim 1, including a plurality of said plate package sections, wherein said ports form inlet and outlet conduits in the plurality of plate package sections.

11. A plate heat exchanger according to claim 1, wherein the plate heat exchanger is a counter current flow plate heat exchanger.

12. A plate heat exchanger according to claim 1, wherein the barrier on each of the plates extends through the first transition area of the respective plate and through a part of the heat transfer area with a gap between a free end of the barrier and the second transition area so that a medium flows along one side of the barrier, through the gap and along an opposite side of the barrier to contribute to defining helical flow paths of first and second media through the plate heat exchanger.

* * * * *